United States Patent [19]

Bald

[11] 4,392,367

[45] Jul. 12, 1983

[54] PROCESS AND APPARATUS FOR THE ROLLING OF STRIP METAL

[75] Inventor: Wilfried Bald, Hilchenbach, Fed. Rep. of Germany

[73] Assignee: Schloemann-Siemag Aktiengesellschaft, Düsseldorf, Fed. Rep. of Germany

[21] Appl. No.: 167,015

[22] Filed: Jul. 9, 1980

[30] Foreign Application Priority Data

Jul. 10, 1979 [DE] Fed. Rep. of Germany ..... 2927769

[51] Int. Cl.[3] ..... B21B 37/10; B21B 27/06

[52] U.S. Cl. ..... 72/12; 72/13; 72/17; 72/201

[58] Field of Search ..... 72/8–13, 72/201, 16, 17

[56] References Cited

U.S. PATENT DOCUMENTS

| | | | |
|---|---|---|---|
| 3,334,508 | 8/1967 | Martin | 72/201 X |
| 3,514,984 | 6/1970 | Cook | 72/201 X |
| 3,802,237 | 4/1974 | Albensi et al. | 72/17 |
| 3,934,438 | 1/1976 | Arimura et al. | 72/9 |
| 3,990,284 | 11/1976 | Barten | 72/9 |
| 4,197,727 | 4/1980 | Ikemi et al. | 72/12 |
| 4,262,511 | 4/1981 | Boisvert et al. | 72/17 |

*Primary Examiner*—Francis S. Husar
*Assistant Examiner*—Jonathan L. Scherer
*Attorney, Agent, or Firm*—Karl F. Ross; Herbert Dubno

[57] ABSTRACT

Process and apparatus for the cold rolling of ferrous metal or nonferrous metal strip, e.g. steel or aluminum strip, in which the strip is passed at a high rate through a multiplicity of cold rolling stands and a coolant is dispensed from nozzles directed against the rolls or the band in the region of the rolling gaps. According to the invention, the planarity of the strip is measured immediately downstream (in the direction of strip movement) of the last rolling stand and deviations from planarity are determined and converted into control signals. The planarity measurement signal is compared with a deviation-maximum signal processor until the measured deviation reaches a first threshold within the range to maximum. Only the coolant spray from the nozzles of the last stand are controlled in a planarity-restoring sense. When the measured deviation exceeds this threshold at least the nozzles of the penultimate stand are controlled.

13 Claims, 3 Drawing Figures

PROCESS AND APPARATUS FOR THE ROLLING OF STRIP METAL

FIELD OF THE INVENTION

My present invention relates to a method of and to an apparatus for the rolling of steel and nonferrous metal strip and, more particularly, to improvements in the control of cold rolling lines for the plane rolling of such strip. The invention also relates to improvements designed to increase the planarity of steel and nonferrous metal strip.

BACKGROUND OF THE INVENTION

Processes and apparatus for the plane (flat) rolling of band-type materials, i.e. steel and nonferrous metal strip, generally make use of high-speed cold-rolling stands provided in a rolling line in the mill and, more particularly, a multiplicity of such stands, each having working rolls defining a gap through which the strip passes at a high rate of speed. The upper and lower working roll is urged against the strip by the top backing up roll while the lower or bottom working roll is supported by the bottom backing up roll in the typical four-high mill stand.

It is known to provide in flattening lines and cold reduction lines of steel strip of this type, a plurality of nozzles to spray coolant in zones selectively and/or with quantities controlled to regulate the planarity of the rolled product.

To this end, deviations from true planarity can be measured upon the strip and the coolant discharge controlled accordingly.

In aluminum cold-rolling lines, for example, it is known to provide a cooling system in which a plurality of individual spray nozzles are trained upon the working rolls, the individual nozzles being controlled by a continuous planarity measurement by means of so-called stressometer rolls.

This process requires an apparatus in which the control valves are disposed above the strip on the mill stands or below the strip and even below the floor of the mill in a construction which permits only the nozzles to be disposed directly in the region of the gap.

Since all of the stands had to be provided with this complex control arrangement in the more common prior art techniques, the capital cost of the system was considerable and repair and maintenance was always a problem.

Furthermore, the control of the planarity left much to be desired, i.e. the rolled product still had a significant deviation from true planarity and all attempts to regulate the line to improve the planarity resulted in compromises to the extent that the product had to be considered acceptable even though the planarity deviated within a fairly wide tolerance range from the ideal.

Since steel and nonferrous metal strip requirements have increased in recent years, the problem of producing such strip with minimum deviation from true or ideal planarity has been magnified.

OBJECTS OF THE INVENTION

It is thus the principal object of the present invention to provide an improved method of operating a cold-rolling line for the plane rolling of steel strip whereby the quality of the finished product is improved, especially in terms of reduced deviation from ideal or true planarity.

Another object of the invention is to provide a method of controlling the planarity of cold rolled steel or nonferrous metal strip which yields a product of improved quality.

Yet another object of this invention is to provide an apparatus, plant or mill line for the cold rolling of steel or nonferrous metal strip which avoids disadvantages of prior art systems at a minimum of cost and capital expenditure.

Still a further object of this invention is to provide an improved and simplified control system for a cold-rolling line of the type used in the production of steel and nonferrous metal strip.

SUMMARY OF THE INVENTION

These objects and others which will become apparent hereinafter are attained, in accordance with the invention, with a cold reduction line for the plane rolling of steel and nonferrous metal strip having a multiplicity of successive rolling stands forming the line with the strip passing through the gaps between the working rolls of each stand in succession in a downstream direction and, after traversing the gap of the penultimate stand and the gap of the final stand of the line, emerging as a rolled product. According to the invention, the working rolls of the last stand, and at least those of penultimate stand are provided with working roll spray-cooling nozzles which are controlled to regulate the planarity of the finished product. Naturally, where the mill comprises a large number of stands, even the stand immediately upstream of the penultimate stand can be provided with a controlled array of nozzles in accordance with this invention. This is what is intended when reference is made to "at least the penultimate stand".

In accordance with the teachings of this invention, the measurement of the planarity is effected exclusively downstream of the last or final stand in the direction of movement of the strip and this measurement is converted into an actual deviation signal. The control system is provided with a transfer function or like memory defining a maximum deviation and compares the actual deviation with this maximum deviation. Until the actual deviation exceeds a predetermined partial deviation value within the range up to maximum, the nozzles are controlled in a planarity-restoring sense. When, however, the actual deviation measurement exceeds this predetermined value, the nozzles of at least the penultimate stand are controlled in addition in a planarity-restoring sense.

The invention is based upon my surprising discovery that the control of all of the cooling stations, i.e. of the nozzles of each of the stands of the entire mill line is not necessary in response to planarity monitoring at the downstream side of the line, but rather that complete and indeed improved correction of the planarity can be effected by regulating the nozzles of only the last two or at most the last three stands when the control is effected in the manner described above.

According to a feature of the invention, the threshold level representing the partial deviation is 30% of the maximum deviation; up to this point only the spray cooling of the working rolls of the last stand is controlled while above this level the spray nozzles of the next-to-last stand are also controlled.

In yet another feature of the invention, the working rolls of all of the stands are cooled by nozzles disposed on both the upstream and downstream sides of each working roll except for the working rolls of the last stand, where such nozzles are provided only on the upstream side. In each case, the upstream side corresponds to the inlet side of the respective gap while the downstream side is the outlet side of the gap.

For especially effective rolling results under practically all conditions and so that substantially all kinds of planarity defects, symmetrical or unsymmetrical defects, can be eliminated, it has been found to be advantageous to provide in addition to the spray cooling in the manner described, control of the roll bending or setting in the respective stands in a positive or negative manner.

I have also found that best results are obtained when the surfaces of the strip are also cooled directly, i.e. by the spraying of a coolant, especially water, directly against these surfaces and/or the surfaces are directly lubricated by spraying the lubricant against the upper and lower surfaces independently of the spraying of the coolant onto the working rolls.

The cooling and lubricating nozzles in accordance with the invention are preferably controlled in response to the temperature measured at the outlet side of the line, i.e. downstream of the last roll stand. Of course, temperature determinations may be taken at other places along the line as well.

The planarity deviation signal may be fed directly to a process controller having the transfer function described above and hence, in its apparatus aspects, the invention provides for a processor responsive to a deviation monitor and controlling independently the nozzles of the last stand and at least the nozzles of the penultimate stand.

According to another feature of the invention, each of the working rolls of each stand has at its upstream side a four-high array of nozzles training respective sprays or jets of the cooling water onto the respective working rolls, each vertically aligned row of such nozzles being controlled in parallel.

Each of the working rolls except for those of the last stand, can also be provided with a two-high array of nozzles on its downstream side, these nozzles also being trained upon the respective working roll.

Naturally, each of the nozzles for each of the rolls of the last and penultimate stand can be provided with a respective control valve which can be operated by the processor.

The nozzles spraying coolant or lubricant onto the upper and/or lower surface of the strip ahead of the last or next-to-last stand, can be spaced across the width of the strip and can be controlled by similarly spaced temperature sensors located on the downstream side of the respective stand. The temperature sensors can work into the same process controller or another process controller.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
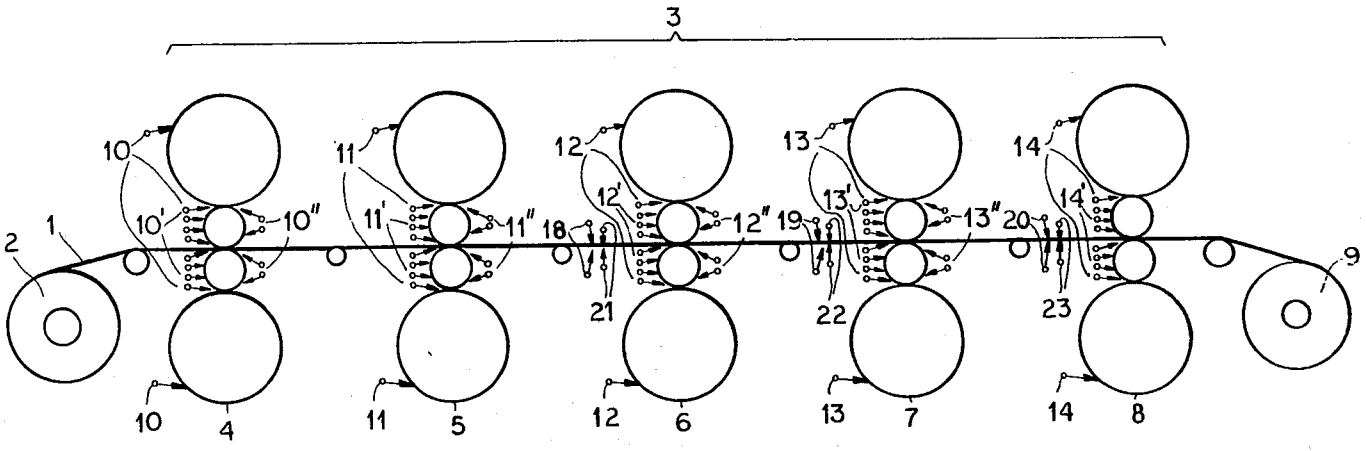
FIG. 1 is a schematic simplified side-elevational view of a five-stand tandem cold reduction line for steel or nonferrous metal strip and especially for the plane cold rolling thereof.

In the drawing I have shown a coil 2 of steel or nonferrous metal strip adapted to be plane rolled in a tandem cold-rolling line 3 which can consist essentially of five four-high mill stands 4, 5, 6, 7, 8. The strip, after leaving the last stand 8, is again wound in a coil 9.

Each of the stands, as has been shown for the last stand 8, comprises a top or upper backing up roll **8*a*, a top working roll 8*b*, a bottom working roll 8*c* and a bottom or lower backing up roll 8*d*. The rolls 8*a* and 8*b* and the rolls 8*c* and 8*d* bear against one another in the usual manner along respective generatrices and the working rolls define gaps such as that represented at 8*e* having its inlet side at the upstream side, i.e. to the left, and its outlet side to the downstream side, i.e. to the right, in FIG. 2** as the strip moves in the direction of arrow A.

The support, drive and bearing structures for the rolls can be conventional in the art as shown, for example at pages 610 ff. of *The Making, Shaping and Treating of Steel,* United States Steel Co., Pittsburgh, Pa. 1971. As is described in this work, moreover, the gap width, the pressure and the bending of the working rolls can be controlled as well.

The bending arrangements can provide a negative and/or positive bend to the working rolls to vary the cross section of the respective gap and thus bring the upper and lower surfaces of the strip 1, as represented at **1*a* and 1*b* (FIG. 3) as close to planarity and parallelity as possible. Such means has been represented by the blocks 8*f* and 8*g* in FIG. 2**.

During the cold-rolling process, the rolling friction, compression and plastic deformation forces are transformed into heat and result in a temperature increase in the strip and of both the working rolls and the backing up rolls, the distribution of the thermal stresses resulting in planarity defects in the finished strip.

To maintain the temperature of the strip and of the working rolls in contact therewith for the individual four-high stands 4–8 within the limits required for optimum planarity, each of the four-high stands is provided with a respective cooling system represented generally at 10, 11, 12, 13 and 14. Each of these cooling systems 10–14 comprises a large number of spray nozzles which have been shown in greater detail for the last two stands in FIG. 2 but which have been represented more generally in FIG. 1.

For example, for the next-to-last or penultimate stand 7, these nozzles include a row of nozzles **13*a*, spaced apart over the length of the upper backing up roll and trained there against, another row of nozzles 13*b* similarly extending parallel to the lower backing up roll and trained thereon and two rows of nozzles 13′ trained upon the working rolls at the upstream side thereof and two rows of nozzles 13″** trained upon the working rolls at the downstream side thereof.

The other stands 4–6 have similar arrays of nozzles.

The upper row of nozzles 13′, for example, consists of a set of four nozzles **13*a*′, 13*b*′, 13*c*′ and 13*d*′, which are vertically aligned and are connected to a common manifold 13*e*′ supplying the cooling water to all of the nozzles of the set. Similar sets are spaced apart in a row parallel to the respective valve such as the valves 13*f*′ and 14*f*′ showing diagrammatically in FIG. 3. The four nozzles 13*a*′–13*d*′** of each set are trained upon each working roll respectively direct their sprays or jets at upper, above-center, below-center and lower positions of the working roll so as to obtain effective coverage by the coolant thereof.

For each of the four stands prior to the last stand 8, the respective downstream set of nozzles 13'' comprises two nozzles 13a'', 13b'' connected to a common manifold, controlled by a corresponding valve and representing one of a number of such sets disposed in a row across the width of the strip 1 parallel to the working roll.

The nozzles 13a'', 13b'' train their respective sprays at upper and lower portions of the respective working roll. Downstream spray nozzles are omitted for the last stand 8.

The nozzles are disposed so that the greater part of the sprays of each cooling arrangement 10–14 is directed against the surfaces of the working rolls and a smaller proportion of the coolant is directed against the surface of the backing up rolls.

The cooling systems 10, 11 and 12 of the first three stands need not be controlled in response to the temperature or planarity sensors described hereinafter but rather the respective jets are set for the optimum spray characteristics required to keep the strip as close to planarity as possible, i.e. to maintain a uniform and constant surface temperature for the working rolls as well as the backing up rolls.

In spite of such adjustments, planarity defects can be observed in the strip. The planarity defects are a result of variations in temperature from the edges to the interior of the strip and which are found to arise even if the temperature of the working rolls is held substantially constant.

Figure 2:
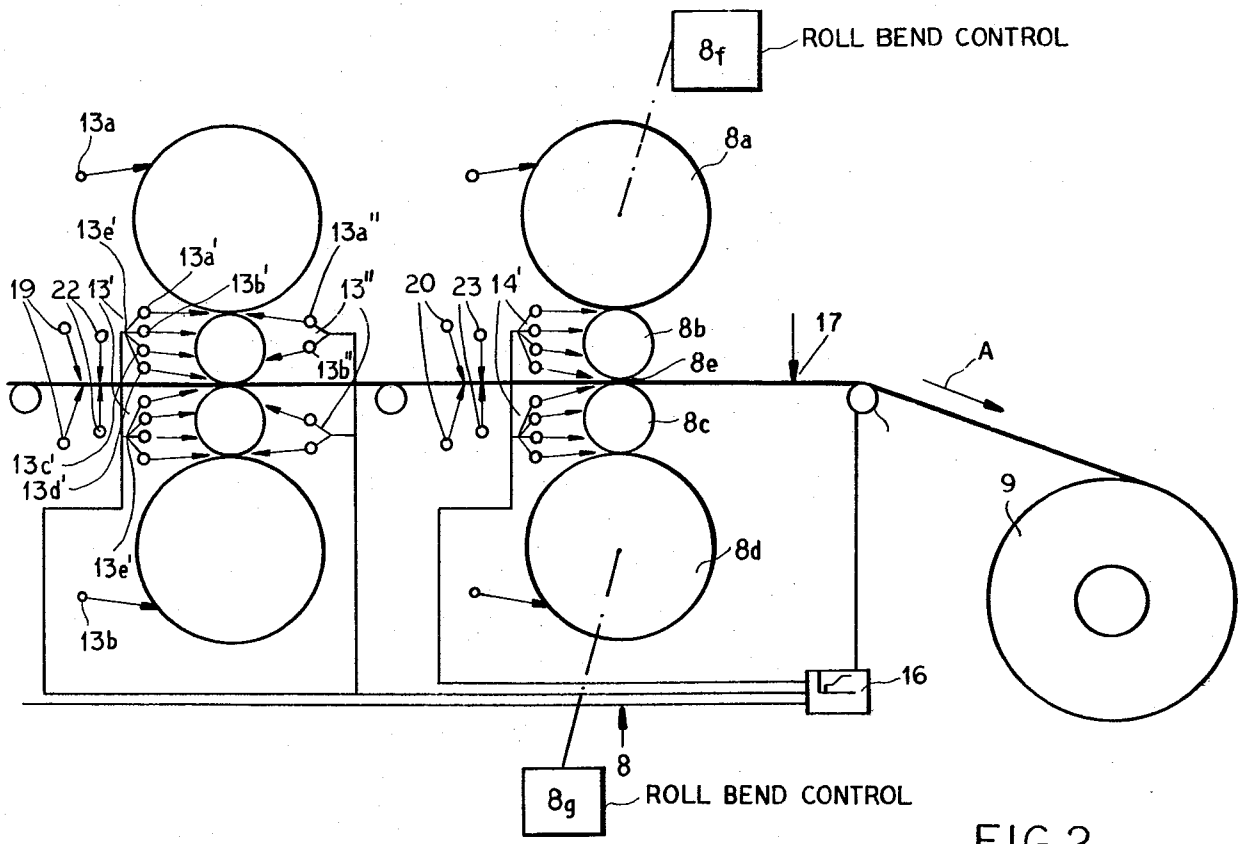
FIG. 2 is a view to a larger scale of the region at the discharge end of this line.
Figure 3:
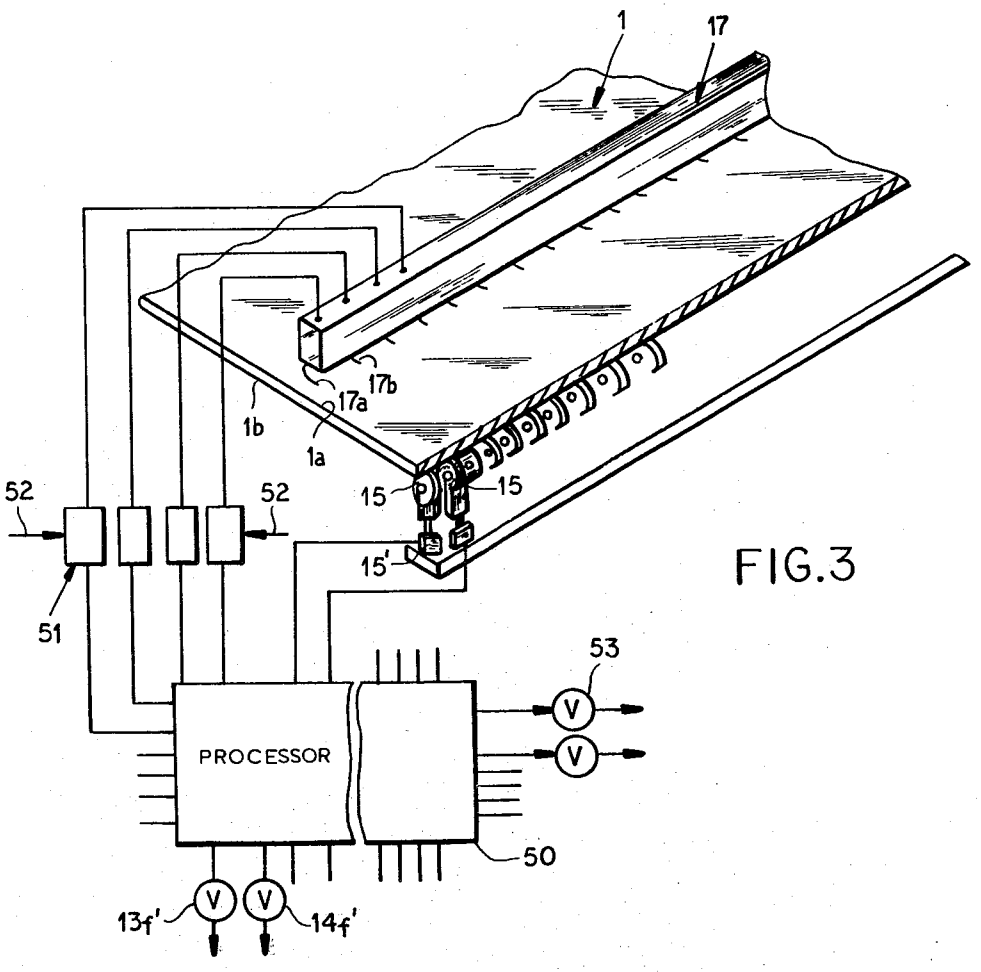
FIG. 3 is a diagram illustrating principles of the invention.

According to the invention, downstream of the last four-high stand 8, the strip is subjected to planarity monitoring, e.g. by a row of stressometer rollers 15 which lie closely adjacent one another and having transducers 15' (FIG. 3) providing signals representing deviations from planarity to the comparator controller which is represented by the processor 50 in FIG. 3 or by the block 16 in FIG. 2.

If it is assumed that the detectors will detect a maximum deviation from planarity $d_m$ during operation, the instantaneous deviation may be a fraction of $d_m$, referred to herein as a partial deviation $d_p$. The comparator controller 16 compares the actual measurement value $d_p$ with a preprogrammed threshold value $d_t$, representing a given fraction of $d_m$, preferably 30% of $d_m$, and operates the valves 14f' of the last stand, in accordance with conventional servocontrol principles, to minimize the value of $d_p$ detected by each of the stressometer rollers 15. During this period exclusively the cooling system 14' of the last four-high stand 8 is controlled in response to the instantaneously detected value of the deviation and the flows to the respective nozzles and nozzle sets are correspondingly adjusted in a proportional control mode (See *Chemical Engineer's Handbook*, McGraw-Hill Book Co., New York, 1973, chapter 22, pages 70 ff.)

When the detected deviation $d_p$ exceeds the threshold value $d_t$, i.e. rises above 30% of the maximum deviation $d_m$, the comparator controller 16 automatically controls the sets 13' of nozzles and/or 13'' of the penultimate four-high stand 7. The flows through the individual sets of nozzles 13' and 13'' are controlled in response to the measured deviation from planarity detected by the associated stressometer roller 15 in a proportional mode to nullify the deviation.

It is also possible, in accordance with the present invention, to control the stand preceding the penultimate stand, i.e. stand 6, in a corresponding manner although this is seldom required. However, this may be done by activating proportional control of the valves to the cooling system 12' and/or 12'' in response to the stressometer roller outputs when the measured deviation $d_p$ exceeds a second threshold value $d_t$, corresponding to 65% of $d_m$.

The roll bend controls for positive and/or negative bending of the working rolls can also be operated by the processor or the controller 16 to eliminate symmetrical planarity defects while unsymmetrical planarity defects are eliminated by proportion control of the nozzles in the manner described.

According to the invention, moreover, temperature measurement as represented by the arrow 17 is effected across the width of the strip downstream of the last stand 8, e.g. by an array of sensors 17a, 17b etc., which provide outputs compared by comparators 51 with set point inputs applied at 52 so that deviations of the actual temperature values from the set point signal are delivered to the controller 16 or the processor 50 to operate further valves 53, for example, which control strip cooling or strip oiling or lubrication. The valve 53 may thus control pairs of nozzles 18, 19 or 20, each representing a row spaced across the strip and located at some distance upstream of the inlet side of the gap of the stands 6, 7, 8 for spraying coolant directly upon the upper and lower surfaces of the strip. Here again the coolant can be water.

Additional rows of nozzles 21, 22, 23 are provided upstream of the inlet side of the gap of each stand 6, 7 or 8 for spraying the lubricant or oil onto the surface under the control of the respective valve 53. The valves 53 for the nozzles 18 through 20 are individually controlled in a proportional control mode by the respective temperature sensors 17a, 17b, etc., aligned in the direction of arrow A with the respective nozzle while the strip lubrication can be turned on or off in response to overall temperature of the strip, e.g. when the final temperature of the strip as a whole is to be reduced.

The tandem cold-rolling line 3 shown in the drawing has been found to provide optimum planarity, automatic response and elimination of both symmetrical and nonsymmetrical planarity defects.

I claim:

1. A method of operating a plane rolling line comprising a multiplicity of cold rolling stands, each having a pair of working rolls defining a gap, said gap being traversed by a strip of steel or nonferrous metal with said strip passing through a penultimate stand and a last stand in succession prior to emerging from said line, the rolls of each stand being cooled by respective arrays of nozzles training coolant on the surfaces of said rolls, said method comprising the steps of:

(a) monitoring deviations from planarity of said strip at a location downstream of said last stand in the direction of movement of said strip through said line and across said strip, said deviations having a maximum value;

(b) proportionally controlling coolant flow through nozzles of said last stand exclusively in response to measured planarity deviation values up to a threshold planarity deviation less than said maximum deviation in a sense tending to reduce the measured deviations; and (c) additionally controlling the nozzles of at least said penultimate stand in response to the measured deviation values only upon the measured deviation values exceeding said threshold, said threshold planarity deviation corresponding to substantially 30% of said maximum value, the control of the flow of coolant being effected by directing coolant only along the upstream side on the surface of the rolls of the last stand and by directing coolant on both the upstream and downstream sides of the rolls of the other stands.

2. The method defined in claim 1, further comprising the step of controlling the bend of said rolls in response to deviations from planarity of said strip.

3. The method defined in claim 1, further comprising the step of directing coolant onto the upper and lower surfaces of said strip between said stands.

4. The method defined in claim 3, further comprising the step of measuring the temperature of said strip at a multiplicity of locations across said strip and regulating the discharge of coolant onto said surfaces of said strip between said stands.

5. The method defined in claim 1 wherein said values are converted into control signals which are processed in a controller to regulate the flow through said nozzles of at least said last stand and said penultimate stand.

6. In a cold-rolling line for the cold reduction of steel or nonferrous metal strip, wherein said strip is passed in succession between working rolls of a multiplicity of rolling stands and respective arrays of nozzles at each of said stands train coolant onto surfaces of the respective rolls, said strip passing through a penultimate stand and a last stand prior to emergence from said line, the improvement comprising:

(a) means for monitoring the planarity of said strip downstream of said last stand in the direction of movement of said strip for producing signals representing deviations from planarity at locations across said strip;

(b) means responsive to said signals for controlling the nozzles of said last stand exclusively upon the detection of planarity deviations up to a threshold value of substantially 30% of the maximum deviation of planarity; and (c) means automatically responsive to said signals for additionally controlling the nozzles of said penultimate stand upon the measured planarity deviation exceeding said threshold value, the means responsive to said signals being constructed and arranged to controlledly cool the rolls of said penultimate and last stands so as to reduce the measured deviation, said means responsive to said signals including a proportional controller, said nozzles being provided only on the upstream side of said last but on both the upstream and the downstream sides of the other stands of said line.

7. The improvement defined in claim 6 wherein said nozzles include sets of four vertically spaced nozzles trained upon each of said rolls at the upstream side thereof and sets of two vertically spaced nozzles trained on the downstream side of the rolls of said other stands.

8. The improvement defined in claim 6 wherein said nozzles are provided with respective valves operated by said controller.

9. The improvement defined in claim 6, further comprising spray means for directing coolant onto upper and lower surfaces of said strip between said stands.

10. The improvement defined in claim 9, further comprising temperature-measuring means extending across said strip downstream of said last stand for controlling said spray means.

11. The improvement defined in claim 10 wherein said spray means includes means for applying a lubricant to said strip.

12. The improvement defined in claim 10 wherein said temperature-measuring means is connected to said spray means through a process controller.

13. The improvement defined in claim 6 wherein said monitoring means includes a plurality of tension and planarity measuring rollers disposed in side-by-side relationship connected to said controller for operating nozzles of said last and penultimate stands at corresponding zones of said strip.

* * * * *